United States Patent [19]

Kiechlin

[11] Patent Number: 4,783,120

[45] Date of Patent: Nov. 8, 1988

[54] SEAT CUSHION

[76] Inventor: Robert J. Kiechlin, 1225 E. Boonville-New Harmony Rd., Evansville, Ind. 47711

[21] Appl. No.: 70,562

[22] Filed: Jul. 7, 1987

[51] Int. Cl.[4] ..... A47C 7/02

[52] U.S. Cl. ..... 297/230; 297/188; 5/462

[58] Field of Search ..... 297/230, 231, 192, 382, 297/252, 188, 219; 5/462, 466

[56] References Cited

U.S. PATENT DOCUMENTS

| | | | |
|---|---|---|---|
| Re. 24,618 | 3/1959 | Rosenberg et al. | 297/DIG. 3 |
| 1,255,481 | 2/1918 | Spranger | 5/462 |
| 2,734,556 | 2/1956 | Hebrank | 297/230 |
| 2,740,466 | 4/1956 | DuPriest | 297/188 |
| 2,865,433 | 12/1958 | Warner | 297/252 |
| 3,112,956 | 12/1963 | Schick et al. | 297/219 |
| 3,580,633 | 5/1971 | DuPriest | 297/188 |
| 3,763,972 | 10/1973 | Karzmar | 297/188 |
| 4,604,987 | 8/1986 | Keltner | 5/462 |

*Primary Examiner*—Francis K. Zugel
*Attorney, Agent, or Firm*—Warren D. Flackbert

[57] ABSTRACT

An independent seat cushion used primarily to provide seating comfort at commercial locations, such as stadiums, conventions, arenas or the like, which is readily carried to the use site, which employs a detachable pouch or pocket for carrying incidental items and, in one form, includes a pivotal back rest. Typically, slide fasteners are employed for pouch or pocket detachment, as well as for the placement of resilient material defining the body of the cushion. The cushion itself can assume various configurations in plan view, and an adjustable strap is provided for ready carrying.

5 Claims, 1 Drawing Sheet

SEAT CUSHION

As is known, the need for comfortable seating in away from home locations, as stadiums, convention areas or the like, is widespread, and particularly in the instance of the elderly. In addition to comfort in seating, it would also be desirable to include article storage with the cushioning, i.e. so as to permit added ease in item carrying, such as newspapers, programs or personal needs, to the event. Moreover, it would be of further importance to add a back rest to the seat cushion to further assure location comfort.

The invention satisfies the preceding by presenting a seat cushion, in any desired shape in plan view, which is readily adaptable to carrying, as by an adjustable shoulder strap, to and from a seating location and, in one form, provides a pocket or pouch, which may be releaseable, for transporting various items without unnecessary hand usage. In a further form, the cushion may include a back rest pivotal from a carrying condition to an on-site use condition.

Typically, the seat cushion of the invention is defined by covered resilient material, such as foam rubber, where the covering material may be washable or a type of material which accommodates various weather conditions during use.

In any event, a better understanding of the present invention will become more apparent from the following description, taken in conjunction with the accompanying drawing, wherein

DESCRIPTION OF THE FIGURES

FIG. 3 is a view in side elevation of another form of seat cushion, in accordance with the teachings of the present invention;

Figure 1:
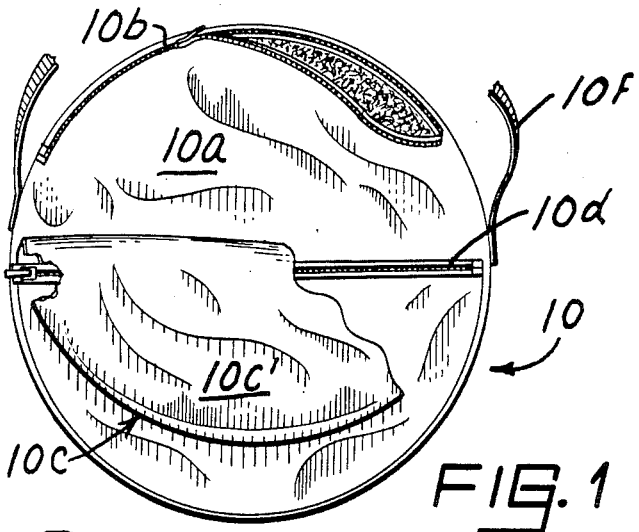
FIG. 1 is a top plan view, partly fragmentary, showing one form of seat cushion in accordance with the teachings of the present invention.

For the purposes of promoting an understanding of the principles of the invention, reference will now be made to the embodiments illustrated in the drawing and specific language will be used to describe the same. It will nevertheless be understood that no limitation of the scope of the invention is thereby intended, such alterations and further modification in the illustrated devices, and such further applications of the principles of the invention as illustrated therein being contemplated as would normally occur to one skilled in the art to which the invention relates.

Figure 2:
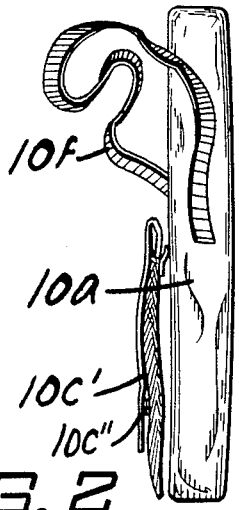

Referring now to FIGS. 1 and 2, one form of seat cushion presented by the invention involves a rounded (in top plan view) seat 10, typically made from a resilient material, such as foam rubber, encased within a covering 10*a*, where a slide fastener 10*b* provides access for placement and/or removal of the resilient material. The seat cushion 10 includes, on one side thereof, a pouch or pocket 10*c*, also positioned by a slide fastener 10*d*, which presents an overlying flap 10*c'* fastened by a snap 10*c''*. An adjustable shoulder strap 10*f* is provided for ease in carrying.

In other words, with the invention form of FIGS. 1 and 2, the seat cushion 10 is readily carried by the user to a location where, at which time, the pouch or pocket 10*c* is removed by slide fastener 10*d* action. Therefore, aside from transporting the seat cushion 10 to the ultimate use location, the desired contents are carried, at the same time, in the pouch or pocket 10*c*.

Figure 3:
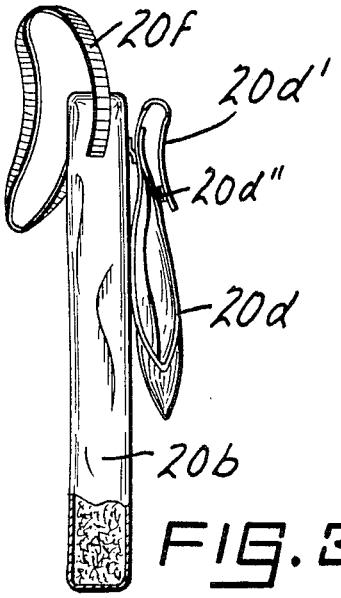
FIG. 3 is a view in side elevation of the invention form of FIG. 1, looking from right to left in such figure.
Figure 4:
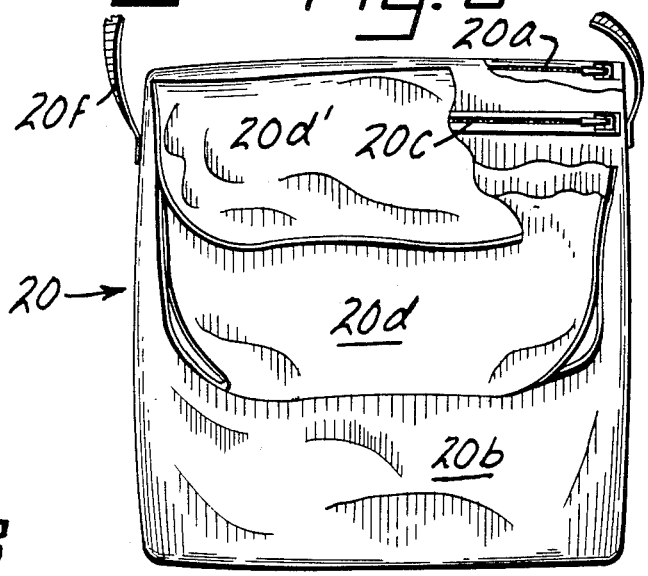
FIG. 4 is a top plan view of the invention form of FIG. 3, looking from right to left in such figure.

FIGS. 3 and 4 show another seat cushion 20 invention form, where, in this instance, the seat portion is relatively square in plan view. Again, a slide fastener 20*a* provides for the placement and/or removal of the resilient material retained within the covering 20*b*. As in the earlier invention form, another slide fastener 20*c* is provided for the ready removal and/or attachment of a pouch and/or pocket 20*d*, with a snap 20*d''* serving to positively secure overlying flap 20*d'* thereof. Again, an adjustable shoulder strap 20*f* is provided for ease in carrying.

In any event, the use of the invention form of FIGS. 3 and 4 closely parallels that of the invention form of FIGS. 1 and 2.

Figure 5:
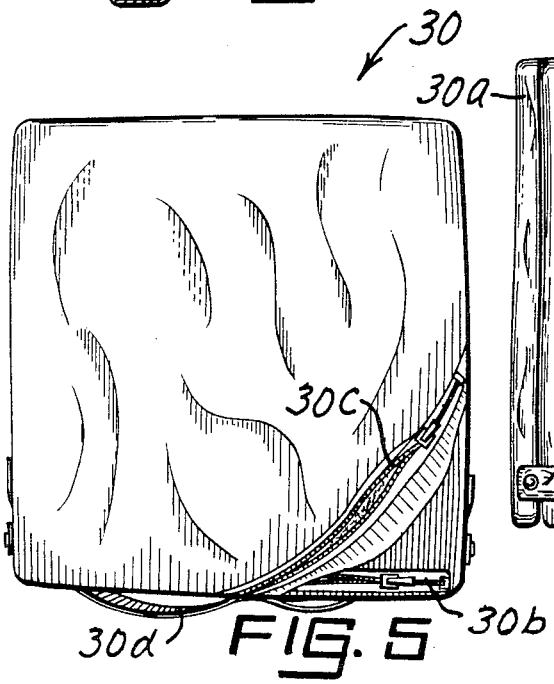
FIG. 5 is a top plan view of still another seat cushion form in accordance with the teachings of the present invention, being partly broken away to reveal the body thereof.
Figure 6:
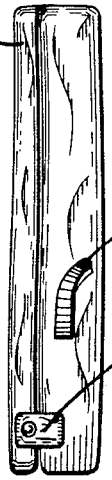
FIG. 6 is a view in side elevation of the invention form of FIG. 5, looking from right to left in such figure; and, FIG. 7 is another view of the invention form of FIG. 5, in this instance, however, showing such in an operative or use condition.
Figure 7:
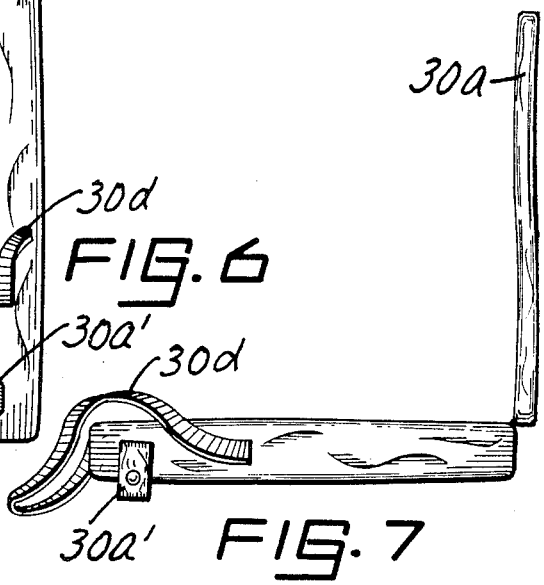

In FIGS. 5, 6 and 7, a disclosed seat cushion 30 form presents, when in an operative condition, a back rest 30*a* (see FIG. 7). In other words, when in a carrying position, the seat cushion 30 assumes the appearance of FIG. 6, where, upon release of tab mounted straps 30*a'*, back rest 30*a* is available by simple pivoting action.

The seat cushion 30 of the FIGS. 5, 6 and 7 invention embodiment may also assume any configuration in plan view, being adapted to being disposed on conventional seating found, for example, in a public area. The seat cushion 30 includes a slide fastener 30*b* entry for the resilient material, and another slide fastener 30*c* entry for the resilient material needed for the back rest 30*a*. Again, an adjustable carrying strap or handle 30*d* is provided for user convenience.

As should be evident from the preceding, the seat cushions presented herein assume a variety of forms, i.e. may or may not include an auxiliary carrying pocket or pouch; may define a back rest in addition to a cushion seat; may be provided with an adjustable shoulder strap or handle for ease in carrying; represents ready assembly by simple placement and/or removal of the cushioning material; and, may be made from a variety of cover materials, and particularly those which are relatively or fully impervious to weathering.

The seat cushion described hereabove is, susceptible to various changes within the spirit of the invention, including, by way of example, proportioning; the securement of the shoulder straps, either at a particular location or, for example, by any desired procedure; the thickness of the cushioning material; the size of the pouch and/or pocket; and, the like. Thus, the preceding should be considered illustrative and not as limiting the scope of the following claims:

I claim:

1. A seat cushion comprising a resilient body portion overlaid by a cover, where a portion of one side of said cover includes an article receiving compartment selectively detachable from said cover to leave an unobstructed seating area when said cushion is used at a seating condition.

2. The seat cushion of claim 1 where said detachable article receiving compartment includes a flap overlying an access opening thereto, and where fastening means maintain said flap in a secured relationship.

3. The seat cushion of claim 1 where a slide fastener on said article receiving compartment serves a selective detaching relationship with respect to said cover.

4. The seat cushion of claim 1 where a back rest pivotally connects thereto, and where said back rest is selectively pivotal from a carrying condition to said seating condition.

5. The seat cushion of claim 1 where a carrying strap is provided.

* * * * *